US008084750B2

(12) United States Patent
Muntean

(10) Patent No.: US 8,084,750 B2
(45) Date of Patent: Dec. 27, 2011

(54) CURVED ION GUIDE WITH VARYING ION DEFLECTING FIELD AND RELATED METHODS

(75) Inventor: Felician Muntean, Danville, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 218 days.

(21) Appl. No.: 12/474,161

(22) Filed: May 28, 2009

(65) Prior Publication Data

US 2010/0301227 A1 Dec. 2, 2010

(51) Int. Cl.
*H01J 3/14* (2006.01)

(52) U.S. Cl. ..... 250/396 R; 250/282; 250/292

(58) Field of Classification Search ..... 250/396 R
See application file for complete search history.

(56) References Cited

U.S. PATENT DOCUMENTS 3,410,997 A * 11/1968 Brubaker ..... 250/290
4,866,279 A 9/1989 Schelten et al.
5,559,327 A 9/1996 Steiner
5,825,026 A 10/1998 Baykut
5,847,386 A * 12/1998 Thomson et al. ..... 250/288
6,525,314 B1 2/2003 Jarrell et al.
6,576,897 B1 6/2003 Steiner et al.
6,891,157 B2 5/2005 Bateman et al.
7,166,836 B1 1/2007 Russ et al.
7,365,317 B2 * 4/2008 Whitehouse et al. ..... 250/292
2002/0014587 A1 2/2002 Benveniste et al.
2004/0227074 A1 11/2004 Benveniste et al.
2007/0138383 A1 6/2007 Dowell et al.
2008/0067365 A1 3/2008 Thakur et al.
2008/0116371 A1 5/2008 Wouters et al.
2009/0095898 A1 4/2009 Collings et al.
2009/0294663 A1 * 12/2009 Muntean et al. ..... 250/292

* cited by examiner

*Primary Examiner* — Phillip A Johnston

(57) ABSTRACT

An ion guide includes a plurality of curved electrodes and an ion deflecting device. The electrodes are arranged about and radially spaced from a central curved axis, and circumscribe a curved ion guide region from an ion entrance to an ion exit. The ion deflecting device may include a device for applying a DC electric field to one or more electrodes in a radial direction. The magnitude of the DC electric field, and thus the ion deflecting force, varies along the curved axis. The ion guide may for example operate as a collision cell or like instrument.

20 Claims, 10 Drawing Sheets

CURVED ION GUIDE WITH VARYING ION DEFLECTING FIELD AND RELATED METHODS

FIELD OF THE INVENTION

The present invention relates generally to the guiding of ions which finds use, for example, in fields of analytical chemistry such as mass spectrometry. More particularly, the present invention relates to the guiding of ions along a curved path while also subjecting the ions to a varying deflecting electrical field in a radial direction relative to the curved path.

BACKGROUND OF THE INVENTION

An ion guide may be utilized to transmit ions in various types of ion processing devices, one example being a mass spectrometer (MS). The theory, design and operation of various types of mass spectrometers are well-known to persons skilled in the art and thus need not be detailed in the present disclosure. A commonly employed ion guide is based on a multipole electrode structure, which may be a RF-only electrode structure in which the ions passing through the ion guide are subjected to a two-dimensional RF electric field that focuses the ions along an axial path through the electrode structure. A DC offset component may also be added to modify the axial energy or focusing conditions of the ion beam.

A curved ion guide is one in which the ion axis along which the ions pass is a curved path rather than a straight path. A curved ion guide is often desirable for implementation in ion processors such as mass spectrometers because the curved ion guide can improve the sensitivity and robustness of the mass spectrometer. A primary advantage of the curved ion guide in such a context is that it provides a line-of-sight separation of the neutral noise, large droplet noise, or photons from the ions, thereby preventing these components from reaching the more sensitive parts of the ion optics and ion detector. Moreover, the curved ion guide enables the folding or turning of ion paths and allows smaller footprints in the associated instruments.

As appreciated by persons skilled in the art, in a curved ion guide the ions are transmitted around a curved ion path through oscillations inside the radial trapping field provided by the RF voltage applied on the rods (i.e., electrodes) of the ion guide. In the absence of the RF field, the ions would move straight and eventually hit the ion guide rods. Therefore, in the curved ion guide the ions need to experience a certain minimum amount of RF restoring force during their flight before they move too close to the ion guide rods and become unstable. When the ion guide transmits one mass at a time, the best performance is obtained when the RF voltage is scanned as a function of mass to optimize transmission. However, it is often desirable to run ions at higher energy and/or transmit ions of multiple different masses (mass-to-charge, or m/z, ratio) simultaneously. In such cases, some of the ions cannot have optimal transmission conditions and they are lost, leading to less than optimal instrument sensitivity.

Accordingly, there has been a need for improved curved ion guides, including ion guides capable of transmitting ions at high levels of kinetic energy and simultaneously transmitting ions of multiple masses while maintaining optimized ion transmission conditions. This need is addressed in U.S. patent application Ser. No. 12/277,198, assigned to the assignee of the present disclosure. The foregoing patent application discloses the application of a deflecting DC electric field on the ion guide in the radial direction toward the center of the ion guide sector, to compensate for the ion kinetic energy and assist in deflecting ions around the curved geometry. The applied radial deflecting electric field may be a function of the ion axial kinetic energy and the dimensions and geometry of the ion guide electrodes. In certain implementations disclosed in the foregoing patent application, the magnitude or strength of this radial DC deflecting field is constant along the ion flight path, i.e., through the ion guide from ion entrance to ion exit.

A radial DC deflecting field that is constant along the ion flight path works well for evacuated or low-pressure ion guides. However, a constant DC deflecting field may not work well for ion guides in which ions lose a significant amount of kinetic energy as they travel through the ion guide, and/or for ion guides in which lower-mass ions are formed in the ion guide and require less deflecting forces than other ions of higher mass that also must be controlled in the same ion guide. Such conditions occur, for example, in ion guides utilized as collision cells and similar devices. The theory, design and operation of collision cells and similar devices are well-known to persons skilled in the art and thus need not be detailed in the present disclosure. Typically, a collision cell is an ion guide that is filled with a neutral gas and may serve as a primary ion optical component of a tandem mass spectrometer and in particular a triple quadrupole mass spectrometer. A collision cell is mainly employed to perform the function of MS/MS or collision-induced dissociation (CID). A collision cell may be curved as discussed above for the general case of ion guides, and a curved collision cell presents similar challenges. In addition to those challenges, in collision cells the ions experience a significant number of collisions with the background gas pursuant to the intended performance of CID or ion fragmentation. Thus, the kinetic energy of these ions decreases continually along the flight path. Moreover, the product ions that are formed as a result of ion-gas molecule collisions have a lower mass and a lower energy than their corresponding precursor ions, such that the product ions require less or no radial deflecting field in order to be successfully contained in the collision cell. It can be seen, then, that a constant DC deflecting field may not provide optimized transmission for all of the various ion masses typically processed in collision cells and like instruments.

Accordingly, there continues to be a need for improved curved ion guides in which ion transmission conditions are optimized, including ion guides such as collision cells in which ions experience appreciable losses of kinetic energy and ions of significantly different masses require deflection.

SUMMARY OF THE INVENTION

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, an ion guide includes a plurality of curved electrodes and an ion deflection device. The curved electrodes are arranged about a central curved axis, the curved central axis being co-extensive with an arc of a circular section having a radius of curvature. Each electrode is radially spaced from the curved central axis. The electrodes circumscribe a curved ion guide region arranged about the curved central axis. The ion guide region begins at an ion entrance and ends at an ion exit. The ion deflecting device is configured for applying a radial DC electric field across the ion guide region at a magnitude that varies along the curved central axis. The magnitude is at a maximum at the ion entrance and decreases along the curved central axis toward the ion exit.

According to another implementation, a method is provided for guiding an ion through an ion guide. The ion is transmitted into a curved ion guide region of the ion guide. The ion guide region is circumscribed by a plurality of curved electrodes arranged about a central curved axis, the curved central axis running through the ion guide region co-extensively with an arc of a circular section having a radius of curvature. Each electrode is radially spaced from the curved central axis, wherein the curved ion guide region is arranged about the curved central axis and begins at an ion entrance and ends at an ion exit. A RF electric field is generated across the ion guide region to focus the ion to motions generally along the curved central axis. A DC offset component may also be added in order to control the incoming energy or focusing properties of the ion beam. A radial DC electric field is generated across the ion guide region at a magnitude that varies along the central curved axis to provide an axially varying, radially directed ion deflecting force. The magnitude is at a maximum at the ion entrance and decreases along the curved central axis.

According to another implementation, the maximum magnitude of the DC electric field generated at the ion entrance has a value $U_{deflect}$ proportional to an initial energy (E) of the ion, the inscribed radius ($r_0$) of the plurality of electrodes about the central axis, and the radius of curvature (R), according to the relation $U_{deflect}=k*E*(r_0/R)$, where k is a constant of proportionality dependent on the cross-section and dimensions of the plurality of curved electrodes.

According to another implementation, the method further includes evacuating the ion guide and mass-analyzing the ion in relation to one or more ions of different masses transmitted into the ion guide region, and/or introducing gas molecules into the ion guide and colliding the ion with one or more of the gas molecules to fragment the ion.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION OF THE INVENTION

The subject matter disclosed herein generally relates to the guiding and deflection of ions and associated ion processing. Examples of implementations of methods and related devices, apparatus, and/or systems are described in more detail below with reference to FIGS. 1-7. These examples are described at least in part in the context of mass spectrometry (MS). However, any process that involves the guiding and deflection of ions may fall within the scope of this disclosure.

Figure 1:
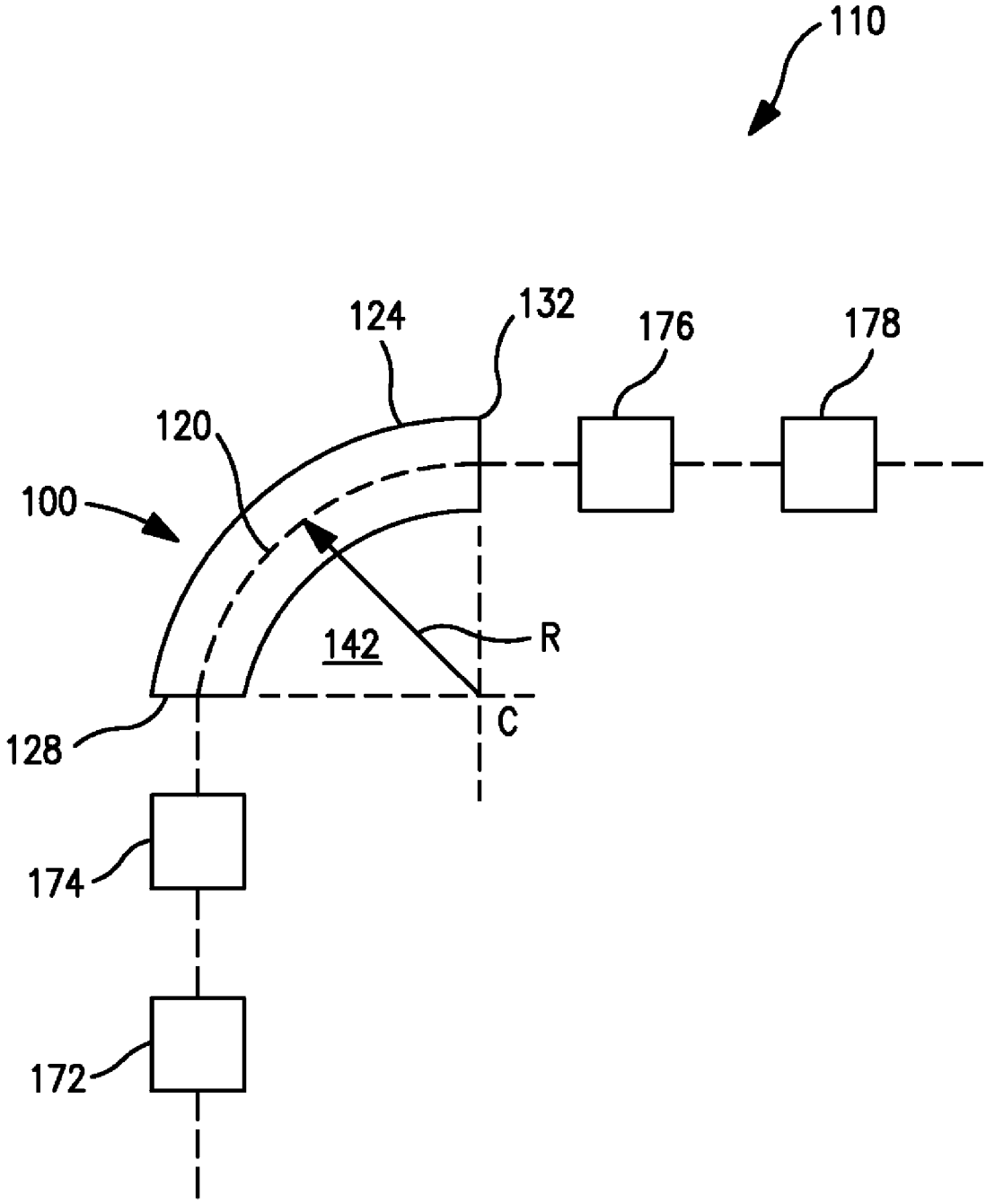
FIG. 1 is a simplified schematic view of an example of an ion guide and an associated ion processing system according to certain implementations of the present disclosure.

FIG. 1 is a schematic view of an example of an ion guide (device, apparatus, assembly, etc.) 100, and further of an example of an ion processing system (or device, apparatus, assembly, etc.) 110 that may include the ion guide 100, according to certain implementations of the present disclosure. The ion guide 100 includes a plurality of curved electrodes (see, e.g., FIG. 2) arranged about a curved central axis 120, which may be referred to as the z-axis. The ion guide 100 may generally include a housing or frame 124, and/or any other structure suitable for supporting the electrodes in a fixed arrangement along the central axis 120. Depending on the type of ion processing system 110 contemplated, the housing 124 may provide an evacuated, low-pressure, or less than ambient-pressure environment. As will become more evident from the description below, the electrodes are generally parallel to each other and to the central axis 120, and are elongated along the central axis 120 in the form of a set of curved rods. By this configuration, the electrodes generally define an interior space within the ion guide 100 that is likewise curved and elongated along the central axis 120. The opposing axial ends of the ion guide 100 respectively serve as an axial ion inlet 128 into the ion guide 100 and an axial ion outlet 132 from the ion guide 100. As appreciated by persons skilled in the art, upon the proper application of RF (or RF/DC) voltages to the electrodes, the electrodes generate a two-dimensional (x-y plane in the present example), quadrupolar, electrical restoring field that focuses ions generally along a curved path represented by the central axis 120. Owing to the curved geometry of the ion guide 100, the respective axes of the ion inlet 128 and the ion outlet 132 are not collinear. Hence, given the fact that only charged particles are influenced by the RF field, when a particle stream containing ions and neutral particles (e.g., gas molecules, liquid droplets, etc.) enters the ion guide 100 via the ion inlet 128, the ions are constrained to motions in the vicinity of the central axis 120 while the neutrals generally continue on a straight path. Consequently, only ions exit the ion guide 100 via the ion outlet 132.

As also illustrated in FIG. 1, the central axis 120 may be conceptualized as running coextensively along the arc of circular section 142 defined by a center of curvature C and a radius of curvature R, with the radius of curvature R being the radial distance between the central axis 120 and the center of curvature C. Accordingly, the ion guide 100 and its corresponding set of electrodes may be characterized as having this radius of curvature R. It will be understood that the central axis 120 may extend along any length of arc of the circle of which the circular section 142 is a part. For instance, in the illustrated example, the length of the central axis 120 is such as to define a circular section 142 taking up a full quadrant of the circle, in which case the respective axes of the ion inlet 128 and the ion outlet 132 are offset by ninety degrees. Thus, in the present example, the ion guide 100 provides a focused ion beam that is transmitted along an ion path shaped as a ninety-degree elbow. In other examples, however, the length of the central axis 120 may be more or less such that the resulting circular section 142 may be larger or smaller than illustrated, and accordingly the angle between the respective axes of the ion inlet 128 and the ion outlet 132 may be greater or less than ninety degrees.

It will be further understood that the illustrated ion guide 100 may represent a portion or section of a larger ion guide (not shown) that includes one or more additional sections positioned upstream and/or downstream of the illustrated ion guide 100. These additional ion guide sections may also be configured as circular sectors but alternatively may follow linear paths or other types of non-circular paths. Thus, one or more ion guides 100, with or without additional, differently shaped ion guides, may be utilized to provide any desired path for an ion beam focused thereby. Thus, in another non-illustrated example, the ion guide 100 may be shaped so as to provide a 180-degree turn in the focused ion path, i.e., a U-shaped ion path. In another example, the "legs" of the U-shaped path may be extended by providing linear ion guide sections adjacent to the ion inlet and the ion outlet of the U-shaped ion guide. In another example, two 90-degree ion guides 100 may be positioned adjacent to one another to realize the 180-degree turn in the ion path. In another example, two similarly shaped ion guides may be positioned adjacent to one another such that the radius of curvature of one ion guide is directed oppositely to that of the other ion guide, thereby providing an S-shaped ion path. Persons skilled in the art will appreciate that various other configurations may be derived from the present teachings.

The ion guide 100 may be utilized in any process, apparatus, device, instrument, system or the like for which a curved, focused ion beam is contemplated for guiding ions from a given source to a given destination. Thus, for example, the ion processing system 110 schematically depicted in FIG. 1 may generally include one or more upstream devices 172 and 174 and/or one or more downstream devices 176 and 178. The ion processing system 110 may be a mass spectrometry (MS) system (or apparatus, device, etc.) configured to perform a desired MS technique (e.g., single-stage MS, tandem MS or MS/MS, MS″, etc.). Thus, as a further example, the upstream device 172 may be an ion source, the downstream device 178 may be an ion detector, and the other devices 174 and 176 may represent one or more other components such as ion storage or trapping devices, mass sorting or analyzing devices, collision cells or other fragmenting devices, ion optics and other ion guiding devices, etc. Thus, for example, the ion guide 100 may be utilized before a mass analyzer (e.g., as a Q0 device), or itself as an RF/DC mass analyzer, or as a collision cell positioned after a first mass analyzer and before a second mass analyzer. Accordingly, the ion guide 100 may be evacuated, or may be operated in a regime where collisions occur between ions and gas molecules (e.g., as a Q0 device in a high-vacuum GC/MS, or a Q0 device in the source region of an LC/MS, or a Q2 device, etc.).

Figure 2:
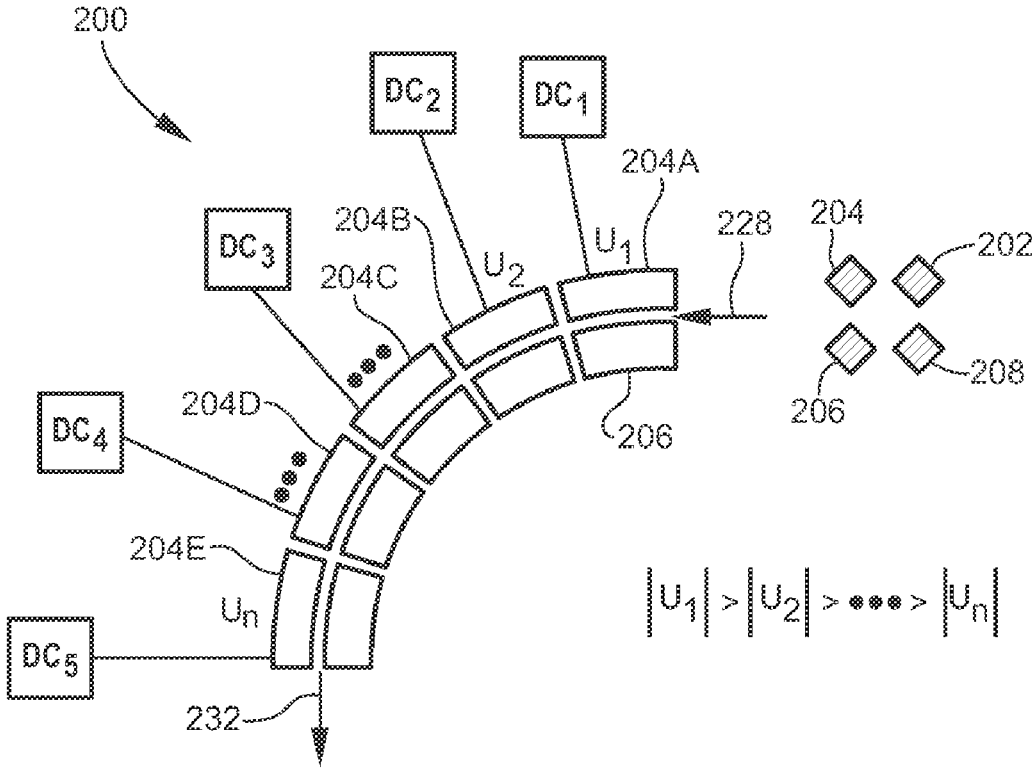
FIG. 2 is a schematic drawing of an example of an ion guide according to an implementation of the present disclosure.

FIG. 2 is a perspective view of an example of a portion of an ion guide 200 that includes a set of parallel, curved ion guiding electrodes 202, 204, 206 and 208. The ion guide 200 may, for example, be utilized as the ion guide 100 described above and illustrated in FIG. 1 and as part of the accompanying ion processing system 110. In this example, the electrode set consists of four electrodes 202, 204, 206 and 208 to form a basic two-dimensional, quadrupolar ion-focusing (or ion-guiding) field. In other implementations, additional electrodes may be included (e.g., a hexapolar or octopolar configuration). Each electrode 202, 204, 206 and 208 is typically spaced at the same radial distance from the central z-axis as the other electrodes 202, 204, 206 and 208, in which case the ion guide 200 may be considered as including a symmetrical arrangement of electrodes 202, 204, 206 and 208. One end of the electrodes 202, 204, 206 and 208 forms an ion entrance 228 and the opposing end forms an ion exit 232. The illustrated electrode set may be considered as including two pairs of opposing electrodes. That is, the electrodes 202 and 206 oppose each other relative to the central z-axis, and the electrodes 204 and 208 oppose each other relative to the central z-axis. Typically, the opposing pair of electrodes 202 and 206 is electrically interconnected, and the other opposing pair of electrodes 204 and 208 is electrically interconnected to facilitate the application of an appropriate RF voltage signal that drives the two-dimensional ion guiding field as described further below. However, the electrodes 202, 204, 206 and 208 may be independently powered so deflection voltages can be added on the outer (or inner) pairs, as described below. In addition, for purposes of describing the presently disclosed implementations, the electrodes 202 and 204 may be considered as outer electrodes and the electrodes 206 and 208 may be considered as inner electrodes. The outer electrodes 202 and 204 are located farther from the center of curvature of the ion guide 200 than the inner electrodes 206 and 208.

As also illustrated by example in FIG. 2, the electrodes 202, 204, 206 and 208 may have square cross-sections (orthogonal to the central z-axis). In this case, the electrodes 202, 204, 206 and 208 may be oriented such that a flat side of each electrode 202, 204, 206 and 208 faces inward toward the interior space (or ion guiding region) of the ion guide 200. For example, the electrodes 202, 204, 206 and 208 may by configured as shown in U.S. Pat. No. 6,576,897, assigned to the assignee of the present disclosure. In some implementations, the flat inward-facing electrode surfaces are preferred in that they contribute to the focusing of ions toward the center of the ion guide 200 by means of a radial DC ion-deflecting electric field as described below. Alternatively, the cross-sections may have another type of rectilinear, prismatic or polygonal shape. The cross-sections may be solid as in the illustrated example or may be hollow. As a further alternative, the cross-section of each electrode 202, 204, 206 and 208 may be such that the portion of the electrode surface facing the interior space (or ion guiding region) is curved. The apex of the curved profile may be the point on the outer surface of the electrode 202, 204, 206 and 208 that is farthest to the central z-axis as in the example shown in FIG. 3B. Alternatively, the curved portion of an electrode may have a hyperbolic profile. As another alternative, the electrodes 202, 204, 206 and 208 may be configured as elongated, cylindrical rods to provide a lower-cost approximation of hyperbolic electrode surfaces. As a further alternative, the electrodes 202, 204, 206 and 208 may be formed from rectilinearly shaped cross-sections or plates that are bent to form hyperbolic or semi-circular surfaces facing the interior space.

Figure 3A:
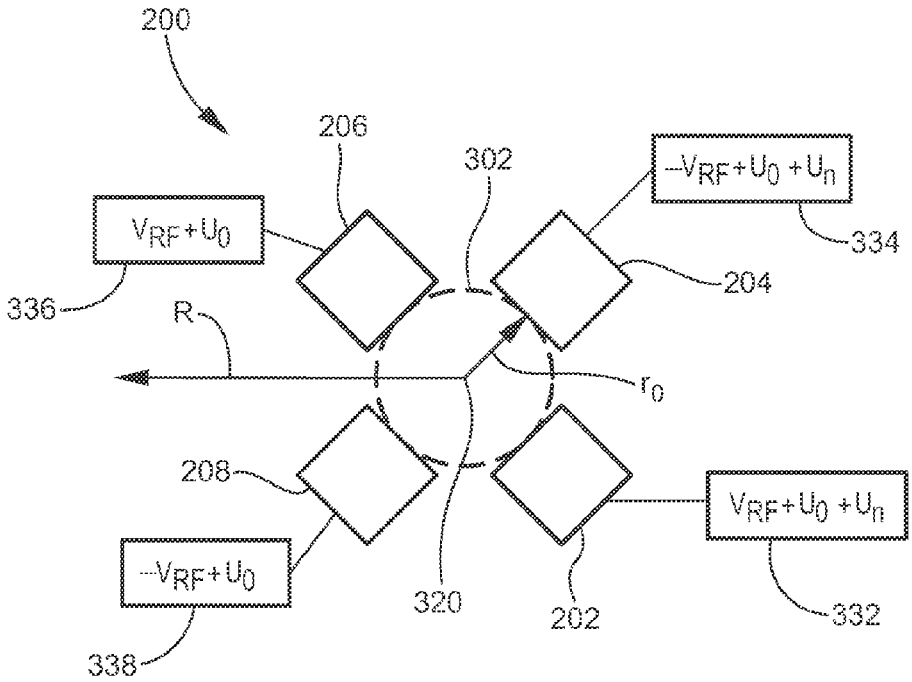
FIG. 3A is a cross-sectional view of the ion guide illustrated in FIG. 2.

FIG. 3A is a cross-sectional view of the electrodes 202, 204, 206 and 208 of the ion guide 200. The electrodes 202, 204, 206 and 208 are symmetrically arranged along a central or z-axis 320, which is curved as described above and illustrated in FIG. 1. Conceptually, the electrodes 202, 204, 206 and 208 are arranged such that their outer surfaces cooperatively define a circle 302 of inscribed radius $r_0$ extending orthogonally from the central axis 320. A similar circle 302 would result in implementations where the electrodes 202, 204, 206 and 208 have curved outer profiles. The interior space of the ion guide 200, and the ion guiding region in which two-dimensional (radial) excursions of the ions are constrained by the applied RF focusing field, are generally defined within this inscribed circle 302. To generate the ion focusing or guiding field, a radio frequency (RF) voltage of the general form $V_{RF}\cos(\omega t)$ is applied to opposing pairs of interconnected electrodes 202, 206 and 204, 208, with the signal applied to the one electrode pair 202, 206 being 180 degrees out of phase with the signal applied to the other electrode pair 204, 208. A DC offset voltage $U_0$ may also be superposed on the RF voltage to modify the ion focusing field. The basic theories and applications respecting the generation of quadrupolar RF fields for ion focusing, guiding or trapping, as well as for mass filtering, ion fragmentation and other related processes, are well known and thus need not be detailed here.

Figure 3B:
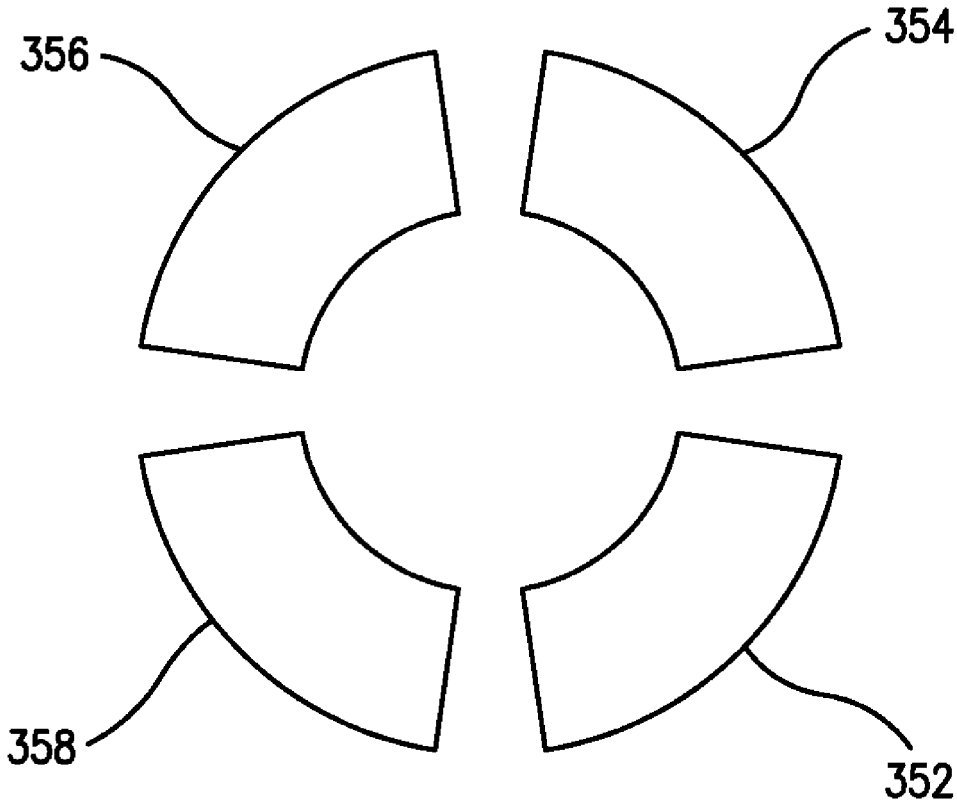
FIG. 3B is a cross-sectional view of an ion guide according to another example.

FIG. 3B is a cross-sectional view of a set ion guiding electrodes 352, 354, 356 and 358 according to another example. The electrodes 352, 354, 356 and 358 are symmetrically arranged along a central or z-axis 320, which is curved as described above and illustrated in FIG. 1. In this example, the cross-sectional profiles of the electrodes 352, 354, 356 and 358 are curved such that their inward-facing surfaces are concave relative to the central axis.

In accordance with the present teachings, the ion guide 200 includes an ion deflecting device or means for applying an ion-deflecting DC electric field in addition to the ion-guiding RF (or RF/DC offset) electric field to assist in keeping ions focused along the curved flight path. The DC ion-deflecting field is applied by impressing a differential DC voltage across the ion guiding region of the ion guide 200, such that the ion-deflecting field is applied in a radial direction generally toward the center of the circular sector of the ion guide 200. Accordingly, the DC ion-deflecting field is oriented in the same x-y plane as the two-dimensional or radial RF ion-guiding field, which plane is orthogonal to the central z-axis 320. In other words, the DC ion-deflecting field is oriented generally in the direction along the radius of curvature R to bias ions generally toward the center of curvature (i.e., generally away from the outer electrodes 202 and 204 and generally toward the inner electrodes 206 and 208). Additionally, the magnitude (or strength) of the DC ion-deflecting field varies along the curved z-axis 320 from a maximum at the ion entrance 228 to a minimum at the ion exit 232 or at some intermediate point between the ion entrance 228 and the ion exit 232. The magnitude of the DC ion-deflecting field thus has an initial value at the ion entrance 228 and decreases along the curved axis 320, either linearly or non-linearly (e.g., exponentially), gradually or step-wise. To generate this axially varying DC ion-deflecting field, the ion deflecting device or means may be implemented in a number of ways, examples of which are described below. Generally, the ion deflecting device or means includes one or more electrodes serving as ion-deflecting electrodes and appropriately positioned so as to generate the ion-deflecting field in the radial direction with a magnitude that varies in the axial direction.

The radial DC ion-deflecting field configured as described herein enables ions to be transmitted through the curved ion guide 200 efficiently at higher kinetic energies than previously practiced for this type of ion guide. The deflection forces imparted to the ions by the DC ion-deflecting field compensate for high ion kinetic energy and assist in guiding the high-energy ions around the curved ion path established by the ion guide 200. Moreover, a larger bandwidth (i.e., a more extensive range of multiple masses) of ions may be transmitted simultaneously through the ion guide 200 while maintaining transmission efficiency. Even at higher kinetic energies and/or greater mass ranges, optimal ion transmission conditions and thus high instrument sensitivity may be maintained in the ion guide 200. Additionally in the present implementation, because the magnitude of the DC ion-deflecting field decreases in the direction from the ion entrance 228 to the ion exit 232 (i.e., along the curved ion flight path), the deflection force imparted to the ions likewise decreases along the ion flight path. This axially varying DC ion-deflecting field is particularly useful in implementations where the ion guide 200 is utilized as a collision cell to fragment parent (precursor) ions into product (daughter) ions. Generally, parent ions entering the ion guide 200 at the ion entrance 228 have a relatively high initial kinetic energy (KE), or initial ion energy (E), and thus require the greatest amount of deflecting force. Accordingly, the magnitude of the DC ion-deflecting field may be set to be proportional to the initial kinetic energy of the parent ions at the ion entrance. The parent ions become progressively less energetic as they collide with gas molecules while traveling though the ion guide 200 toward the ion exit 232, and thus require progressively less amounts of deflecting forces along their curved ion flight path. The progressively decreasing strength of the DC ion-deflecting field along the ion flight path assists in ensuring that the transmission of the parent ions remains optimized. Moreover, the product ions are formed (via collisions between parent ions and gas molecules) at points intermediate of the ion entrance 228 and the ion exit 232 and may have much lower axial kinetic energies than their parent ions. Hence, the product ions require much less deflecting force than the parent ions. The lower strength of the DC ion-deflecting field at points remote from the ion entrance 228 thus also assists in ensuring that the transmission of the product ions is optimized.

As noted above, the value of the magnitude of the DC ion-deflection voltage initially applied at the ion entrance, $U_{deflect,initial}$, may generally be set in proportion to the ion energy (E) possessed by the parent ions at the ion entrance 228. This initial value of the DC magnitude generally correlates to an amount of deflecting force imparted to the parent ions that is optimal for transmission at least in the region of the ion entrance 228, before the parent ions begin to appreciably lose axial kinetic energy. Insofar as the DC magnitude is varied so as to maintain optimal ion transmission in response to loss of axial kinetic energy, this initial value of the DC deflecting voltage magnitude applied at the ion entrance 228 is typically the maximum value of the DC deflection voltage magnitude applied to the ion guide 200. This initial value of the DC deflection voltage magnitude may generally be the same as the value that would optimize transmission of the parent ions over the entire flight path of the ion guide 200 in an evacuated state—i.e., in a case where no significant ion-gas collisions and hence no significant loss of axial kinetic energy are occurring. In one example, the applied initial DC ion-deflection voltage $U_{deflect,initial}$ is set to be proportional to the initial ion energy (E) and to the ratio of the distance across opposite electrodes 202 and 206 (or 204 and 208) to the radius of curvature R of the ion guide 200. For example, in the symmetrical electrode arrangement illustrated in FIG. 3A, the distance across opposing electrodes may be represented by a function proportional to the radius $r_0$ of the inscribed circle 302. Accordingly, in this example the absolute value of the initially applied DC ion-deflection voltage may be set according to the following relation: $U_{deflect,initial}=k*E*(r_0/R)$, wherein k is a constant of proportionality dependent on the geometry and size (e.g., the cross-section and dimensions) of the electrodes 202, 204, 206 and 208. As one non-limiting example, results from simulations utilizing SIMION® ion modeling software (Scientific Instrument Services, Inc., Ringoes, N.J.) indicated that for an ion guide 200 with electrodes 202, 204, 206 and 208 of square cross-section, $r_0$=3 mm, R=60 mm, and E=100 eV, the optimum initial DC ion-deflection voltage $U_{deflect,initial}$=16.8 V.

The rate of decrease of the DC ion-deflection voltage from the initial value may be determined from the rate of decrease of the axial kinetic energy of the parent ion. Thus, the rate of decrease may depend on factors such as the gas pressure within the ion guide 200, the temperature, the collision cross-section between the parent ion and the collision gas molecules (which in turn is a function of the respective types and masses of the parent ion and the neutral gas molecules and their relative velocities), etc. Generally, the particular rate of decrease determined or calculated will be application-dependent and need to be empirically optimized. However, for a common range of applications, preliminary simulations indicate that for a particular ion guide geometry, and for a particular collision gas type and pressure, a fixed (power law or exponential) rate of decrease in the strength of the ion-deflecting field provides good ion transmission for a variety of parent ions and product ions. Moreover, for simplicity of implementation, the radial deflection field could be applied only on an initial sector (or a series of initial sectors) of the collision cell. This is due to the fact that the ions lose energy by collisions along their path and that the radial deflection may not be needed beyond the point where they have lost sufficient energy to be contained by the RF field.

FIG. 2 illustrates one example of how the axially varying DC ion-deflecting field may be implemented. In this example, the outer electrodes 202 and 204 are utilized not only as ion-guiding electrodes but also as ion-deflecting electrodes. Here again, the terms "outer" and "inner" inform the relative radial positions of the electrodes 202, 204, 206 and 208 relative to the center of curvature of the curved ion guide 200. Additionally in this example, the pair of outer electrodes 202 and 204 are segmented (divided) into a plurality of corresponding pairs of outer electrode segments (sections) physically spaced from each other by gaps along the curved axis. By this configuration, DC ion-deflecting voltages of differing magnitudes $U_n$ may be applied to respective pairs of outer electrode segments. Consequently, the radial DC ion-deflecting electric field generated across the ion guiding region has a different strength in each corresponding axial portion of the ion guide 200. The DC potential difference is defined by the DC voltage $U_n$ applied to a given outer electrode pair relative to the opposing inner electrodes 206 and 208. When an optional DC offset voltage $U_0$ is superposed on the RF voltage$\pm V_{RF}$ applied to the inner electrodes 206, 208 and the outer electrodes 202, 204, the DC potential difference is defined by the DC voltage $U_n$ applied to a given outer electrode pair relative to the DC offset voltage $U_0$, or $(\pm V_{RF}+U_0)+U_n$. In the present example, there are five pairs of electrode segments: first outer electrode segments 202A and 204A, second outer electrode segments 202B and 204B, third outer electrode segments 202C and 204C, fourth outer electrode segments 202D and 204D, and fifth outer electrode segments 202E and 204E (see also FIGS. 6 and 7). Thus, taking the optional DC offset voltage $U_0$ into account, the composite or combined voltages applied to the electrodes 202, 204, 206 and 208 are as follows:

first outer electrode segment 202A: $(V_{RF}+U_0+U_1)$,
second outer electrode segment 202B: $(V_{RF}+U_0+U_2)$,
third outer electrode segment 202C: $(V_{RF}+U_0+U_3)$,
fourth outer electrode segment 202D: $(V_{RF}+U_0+U_4)$,
fifth outer electrode segment 202E: $(V_{RF}+U_0+U_5)$,
first outer electrode segment 204A: $(-V_{RF}+U_0+U_1)$,
second outer electrode segment 204B: $(-V_{RF}+U_0+U_2)$,
third outer electrode segment 204C: $(-V_{RF}+U_0+U_3)$,
fourth outer electrode segment 204D: $(-V_{RF}+U_0+U_4)$,
fifth outer electrode segment 204E: $(-V_{RF}+U_0+U_5)$,
inner electrode 206: $(V_{RF}+U_0)$, and
inner electrode 208: $(-V_{RF}+U_0)$.

To generate a DC ion-deflecting electric field that progressively decreases in strength from the ion entrance 228 toward the ion exit 232, the DC voltages applied to the respective outer electrode pairs may be set such that $U_1>U_2>U_3>U_4>U_5$.

While FIG. 2 illustrates five pairs of outer electrode segments, more or less than five pairs may be provided. Generally, the number N ($N\geqq 2$) of pairs corresponds to the number of different levels of DC ion-deflecting field strength desired for a given application. The segmented electrode arrangement will at least include a first pair of outer electrode segments located at the ion entrance 228 and a last (or $N^{th}$) pair of outer electrode segments located at the ion exit 232, wherein a DC ion-deflecting voltage of a first magnitude $U_1$ is applied to the first outer electrode pair and a DC ion-deflecting voltage of an $N^{th}$ magnitude $U_N$ is applied to the Nth outer electrode pair and $U_1>U_N$. The DC ion-deflecting voltage applied to any given outer electrode pair may then be generally expressed as $U_n$ where n is an integer ranging from 1 to N. Moreover, while FIG. 2 illustrates equal-length outer electrode segments, the respective lengths of one or more outer electrode segments may differ from other outer electrode segments to further modify the profile of the applied radial DC electric field as desired and further enhance optimization of ion transmission for a given application. For instance, the respective lengths of the outer electrode segments may progressively increase in the curved axial direction from the ion entrance 228 to the ion exit 232 such that the stronger radial deflecting forces are imparted over shorter lengths of the ion guide 200 and the weaker radial deflecting forces are imparted over longer lengths of the ion guide 200.

It will be appreciated by persons skilled in the art that the DC ion-deflecting magnitudes given above may be considered as being absolute values. The respective signs or polarities of the DC magnitudes depend on whether positive or negative ions are to be deflected. In the specific example illustrated in FIG. 2, positive values for DC ion-deflecting magnitudes $U_n$ may be applied to provide repelling forces for positive ions as they are guided through the curved ion guiding region of the ion guide 200, but alternatively negative values could be applied to provide repelling forces for negative ions. In the case of either positive or negative ions, the ions are deflected in radial directions generally toward the curved central axis by repelling forces. An alternative implementation is readily seen from FIG. 2 in which positive or negative ions may be deflected in radial directions toward the curved central axis by attracting forces. Specifically, the inner electrodes 206, 208 may be axially segmented instead of the outer electrodes 202, 204 and the DC ion-deflecting magnitudes $U_n$ applied to the resulting pairs of inner electrode segments (not shown). In this alternative implementation, negative DC voltages applied to the inner electrode segments would attract (or pull) positive ions toward the curved central axis, or positive DC voltages applied to the inner electrode segments would attract negative ions toward the curved central axis.

In one aspect of the present example, the segmented configuration of the electrodes 202, 204, 206 and 208 may be considered as being a part of the ion deflecting device of the ion guide 200. In another aspect, the means, circuitry or devices utilized to apply the DC ion-deflecting voltages may be considered as being a part of the ion deflecting device. FIG. 2 may be considered as schematically depicting the components or circuit elements utilized for generating and applying the radical DC deflecting field across the ion guide region. FIG. 3 may be considered as schematically depicting the components or circuit elements utilized for generating and applying the two-dimensional RF (or RF/DC) ion-guiding field and the radial DC deflecting field across the ion guide region. These components may be embodied in one or more DC and RF voltage sources or signal generators. It will be understood that such "sources" or "generators" may include hardware, firmware, analog and/or digital circuitry, and/or software as needed to implement the desired functions of the devices or means. The specific components utilized for implementing the DC and RF fields are appreciated by persons skilled in the art and thus are not detailed herein. As one example, FIG. 2 schematically illustrates DC voltage sources $DC_1$, $DC_2$, $DC_3$, $DC_4$ and $DC_5$ (or components $DC_1$, $DC_2$, $DC_3$, $DC_4$ and $DC_5$ of a DC voltage source) place in electrical signal communication with corresponding outer electrode segments 202A/204A, 202B/204B, 202C/204C, 202D/204D and 202E/204E for applying the respective DC ion-deflecting voltages $U_1$, $U_2$, $U_3$, $U_4$ and $U_5$. As another example, FIG. 3 schematically groups the various RF and DC voltages applied into combined functional or circuit elements 332, 334, 336 and 338 placed in electrical signal communication with corresponding electrodes 202, 204, 206 and 208. It will also be understood that the circuity associated with the ion guide 200 may include an electronic controller (not shown), for example, one or more computing or electronic-processing devices. Such an electronic controller may be configured for controlling the operating patameters of the various voltage sources utilized to apply the RF and DC fields. The electronic controller may also coordinate the operation of the ion guide 200 with other operative components of an ion processing system of which the ion guide 200 may be a part, such as the ion processing system 110 illustrated in FIG. 1.

In addition to the radial DC electric field, an axial DC electric field may be applied to the ion guide 200 along the central axis to control ion energy (e.g., axial ion velocity). An axial DC electric field may be particularly desirable in a case where ions being transmitted through the ion guide 200 experience collisions with neutral gas molecules (e.g., background gas). As appreciated by persons skilled in the art, such collisions may be employed for ion fragmentation or for collisional cooling. A DC voltage source or sources may be utilized to generate the axial DC electric field. The DC voltage source or sources may communicate with one or more of the electrodes 202, 204, 206 and 208 or with an external field generating device such as, for example, one or more other conductive members (e.g., resistive traces) positioned along the ion guide axis such as outside the top and/or bottom of the ion guide 200, and/or between the two adjacent electrodes 202, 204, 206 and 208, etc. This "axial" DC voltage source may be conceptualized as being a part of one or more of the circuit elements schematically depicted in FIG. 2 or 3A.

Figure 4:
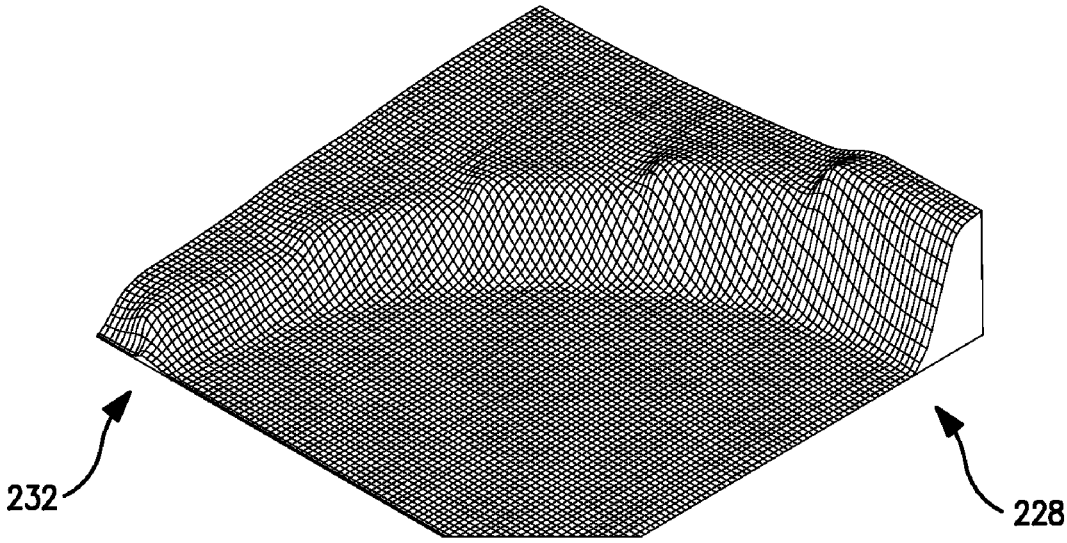
FIG. 4 is a SIMION® computer simulation of a DC potential applied to an ion guide according to an implementation of the present disclosure, from the perspective of a horizontal cross-section through a curved central axis of the ion guide.
Figure 5:
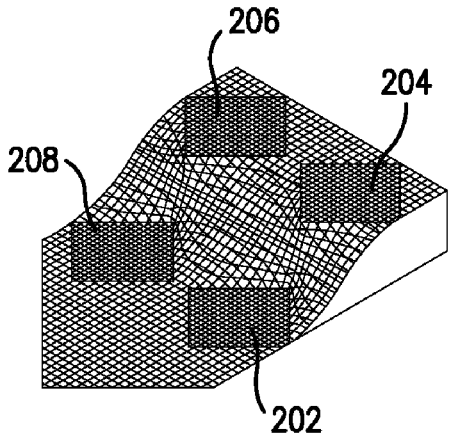
FIG. 5 is a SIMION® computer simulation of the DC potential applied as in FIG. 4, from the perspective of a radial cross-section across an ion guiding region of the ion guide.

The axially varying, radial directed DC ion-deflecting field may be visualized by referring to FIGS. 4 and 5. FIG. 4 illustrates the horizontal cross-section through the curved central axis of the applied DC potential, as calculated from a SIMION® computer simulation. The electrical potential decreases along the curved central axis from the ion entrance 228 toward the ion exit 232. When the DC ion-deflecting field is implemented by way of a segmented electrode arrangement such as described above, the potential energy decreases in a step-wise manner from one segmented portion to the next as shown in FIG. 4. FIG. 5 illustrates the radial cross-section across the ion guiding region of the applied DC potential, as calculated from the SIMION® computer simulation. At any point along the curved central axis, the ions are focused toward the central axis with an optimized amount of applied deflecting force.

Figure 6:
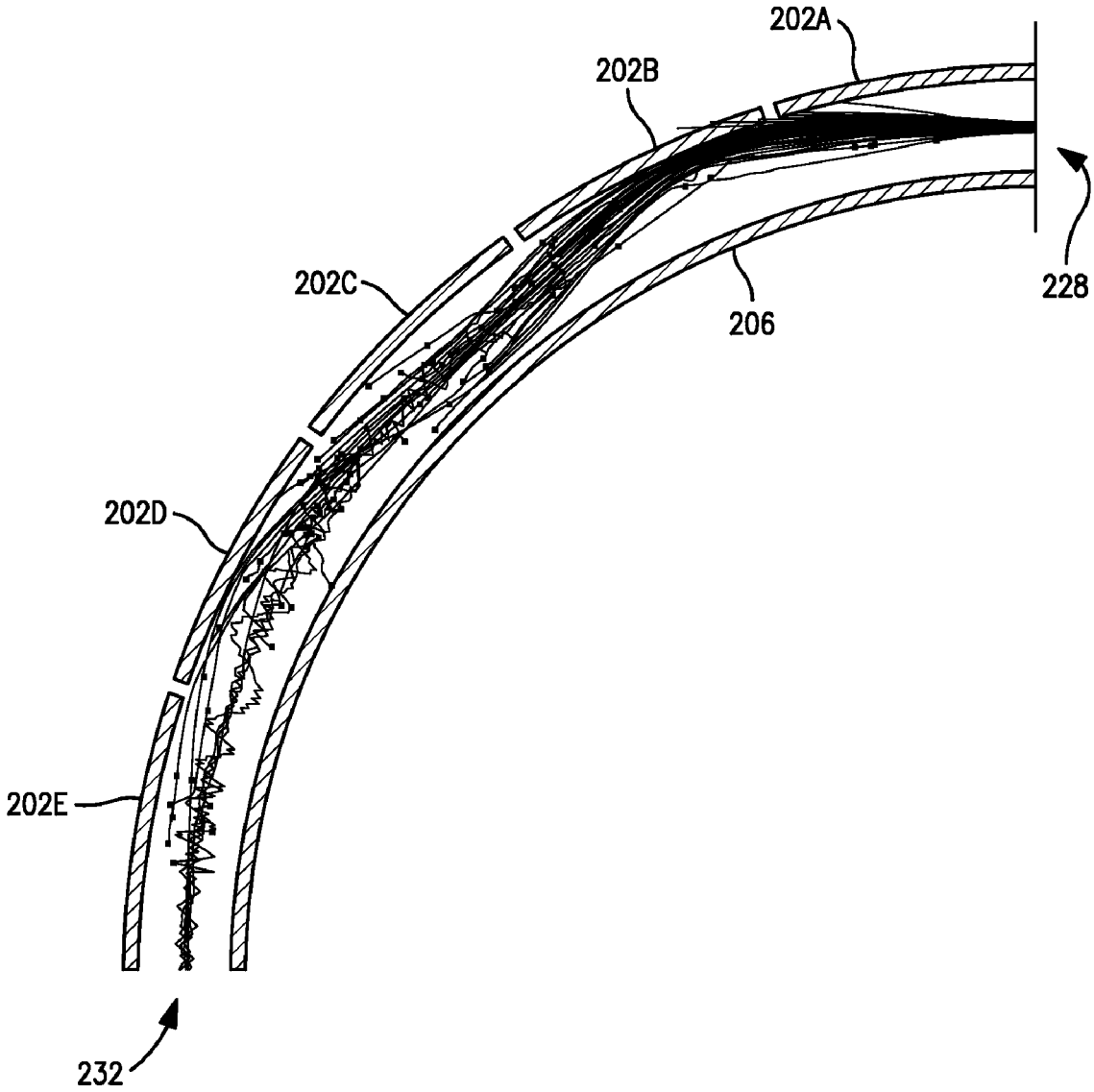
FIG. 6 is a SIMION® computer simulation of ion trajectories through a curved ion guide operating as a collision cell, with no radial DC deflecting field applied.
Figure 7:
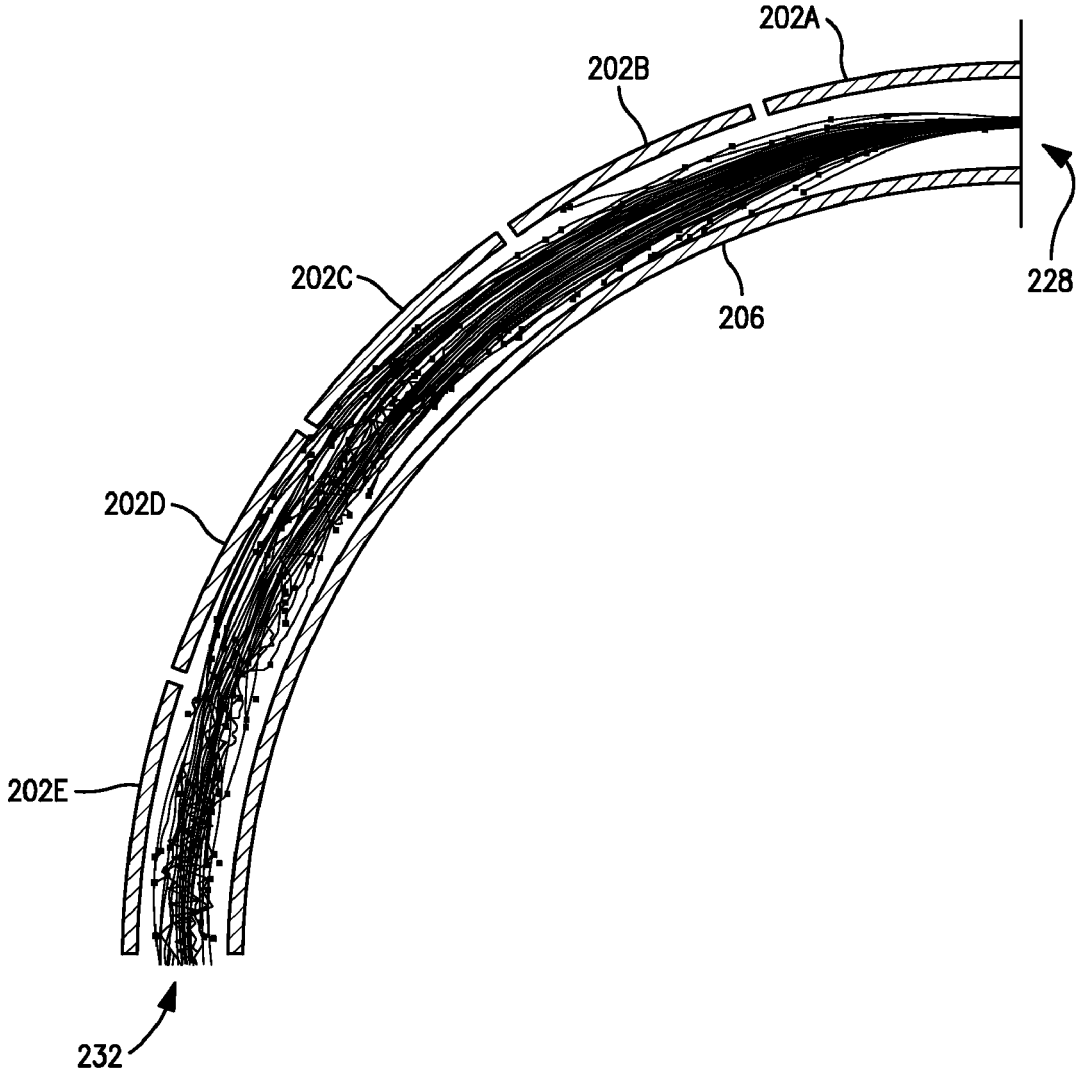
FIG. 7 is a SIMION® computer simulation of ion trajectories through the same curved collision cell as in FIG. 6, but with an axially varying radial DC deflecting field applied in accordance with the present teachings.

Some advantages provided by an axially varying DC ion-deflecting field may be visualized by comparing FIGS. 6 and 7. FIG. 6 is a simulation of ion trajectories through a curved ion guide operating as a collision cell with no radial DC deflecting field applied. FIG. 7 is a simulation of ion trajectories through the same curved collision cell but with the axially varying radial DC deflecting field applied in accordance with the present teachings. In FIGS. 6 and 7, the collision cell includes a curved, quadrupolar electrode arrangement extending between an ion entrance 228 and an ion exit 232 as described above. Although no radial DC deflecting field is applied to the electrode set in FIG. 6, the outer electrodes 202, 204 were nonetheless segmented so as to match the structural conditions illustrated in FIG. 7. Using the SIMION® ion modeling package, ion trajectories were simulated for a basic ion-molecule collision model. Collisions were modeled using a hard sphere elastic collision model, and dissociation was modeled by assuming that product ion velocity at the time of product formation was simply equal to the parent ion velocity. A simple variable describing the number of collisions required to dissociate was utilized to control the dissociation bond strength. In these simulations, parent ions having a mass of 800 Da (or mass-to-charge ratio m/z, where charge z=1) collided with argon (Ar) gas molecules at a collision energy of 100 eV (lab frame) and at a collision pressure of about 0.25 Pa. The collisions yielded product ions of mass 100 Da. A product ion was assumed to form after every ten (10) collisions of a parent ion with a collision gas molecule. The collision cell was modeled with a quadrupolar square rod cross section with $r_0$=3 mm and the curvature radius of 60 mm. A two-dimensional RF trapping field was generated by applying a RF trapping voltage $V_{RF}$ of 235 V peak-to-peak at a frequency of 2 MHz, corresponding to Mathieu q parameter values of 0.04 for the parent ion and 0.32 for the product, respectively.

In FIG. 6 (no DC deflecting field), it is observed that due to the high kinetic energy of the parent ions, few are contained within the collision cell and most collide with the electrodes before having a chance to form product ions. The CID efficiency of this collision cell may be defined as the ratio of the number of product ions successfully exiting the collision cell to the number of parent ions entering the collision cell. The CID efficiency of the collision cell in FIG. 6 was below 5%. By comparison, in FIG. 7 an axially varying DC deflecting field is applied to the same collision cell. The DC voltage applied to the first group of electrodes (the first pair of outer electrode segments, located at the ion entrance 228) was $U_1$=16.8 V. The rate of decrease for the applied DC voltage from segment to segment was 30%, i.e., $U_2=0.7\times U_1$, $U_3=0.7\times U_2$, etc. All other operating conditions were the same as for the simulation shown in FIG. 6. In FIG. 7, it can be seen that the parent ions are well contained and guided on curved trajectories along the curvature of the collision cell, such that only a small fraction of the parent ions are lost. The CID efficiency of the collision cell in FIG. 7 was about 30%. From the foregoing, it may be concluded that when a curved ion guide as disclosed herein is utilized as a collision cell, the CID efficiency of a process modeled above may be increased by at least a factor of 6×.

Referring back to FIG. 2, in another implementation, the inner electrodes 206, 208 as well as the outer electrodes 202, 204 may be segmented. This implementation is not specifically illustrated but is readily ascertainable from FIG. 2. A progressively decreasing series of DC voltages $U_n$ may be applied on a segment-by-segment basis in the same manner as described above for FIG. 2. Alternatively, the full segmentation of the presently described implementation enables a bipolar DC deflecting field to be generated, by applying DC voltages of opposite polarities to the opposing inner and outer electrode segments of each electrode group. Thus, for negative ions negative DC voltages may be applied to the outer electrodes and positive DC voltages applied to the inner electrodes, and vice versa for positive ions. Thus, taking the optional DC offset voltage $U_0$ into account, the composite or combined voltages applied to the electrodes 202, 204, 206 and 208 for positive ions may be as follows:

first outer electrode segment 202A: $(V_{RF}+U_0+U_1)$,
first inner electrode segment, opposite to first outer electrode segment 202A: $(V_{RF}+U_0-U_a)$,
second outer electrode segment 202B: $(V_{RF}+U_0+U_2)$,
second inner electrode segment, opposite to second outer electrode segment 202B: $(V_{RF}+U_0-U_b)$,
third outer electrode segment 202C: $(V_{RF}+U_0+U_3)$,
third inner electrode segment, opposite to third outer electrode segment 202C: $(V_{RF}+U_0-U_c)$,
fourth outer electrode segment 202D: $(V_{RF}+U_0+U_4)$,
fourth inner electrode segment, opposite to fourth outer electrode segment 202D: $(V_{RF}+U_0-U_d)$,
fifth outer electrode segment 202E: $(V_{RF}+U_0+U_5)$,
fifth inner electrode segment, opposite to fifth outer electrode segment 202E: $(V_{RF}+U_0-U_e)$,
first outer electrode segment 204A: $(-V_{RF}+U_0+U_1)$,
first inner electrode segment, opposite to first outer electrode segment 204A: $(-V_{RF}+U_0-U_a)$,
second outer electrode segment 204B: $(-V_{RF}+U_0+U_2)$,
second inner electrode segment, opposite to second outer electrode segment 204B: $(-V_{RF}+U_0-U_b)$,
third outer electrode segment 204C: $(-V_{RF}+U_0+U_3)$,
third inner electrode segment, opposite to third outer electrode segment 204C: $(-V_{RF}+U_0-U_c)$,
fourth outer electrode segment 204D: $(-V_{RF}+U_0+U_4)$,
fourth inner electrode segment, opposite to fourth outer electrode segment 204D: $(-V_{RF}+U_0-U_d)$,
fifth outer electrode segment 204E: $(-V_{RF}+U_0+U_5)$, and
fifth inner electrode segment, opposite to fifth outer electrode segment 204E: $(-V_{RF}+U_0-U_e)$.

The magnitudes of the DC voltages applied to the inner electrode segments, $U_a$, $U_b$, . . . $U_e$, may be set as needed to obtain the desired voltage potentials between corresponding inner electrode segments and outer electrode segments.

Moreover, when both the inner electrodes 206, 208 and the outer electrodes 202, 204 are axially segmented as just described, additional DC voltages may be applied in such a way that adds an axial acceleration field to speed up the exiting of the product ions out from the ion guide. One way this could be implemented is by adding an additional DC offset on each segment (same on all rods within a segment) such that this DC offset contributes to a potential difference from segment to segment in such way to accelerate ions toward the exit of the collision cell.

Figure 8:
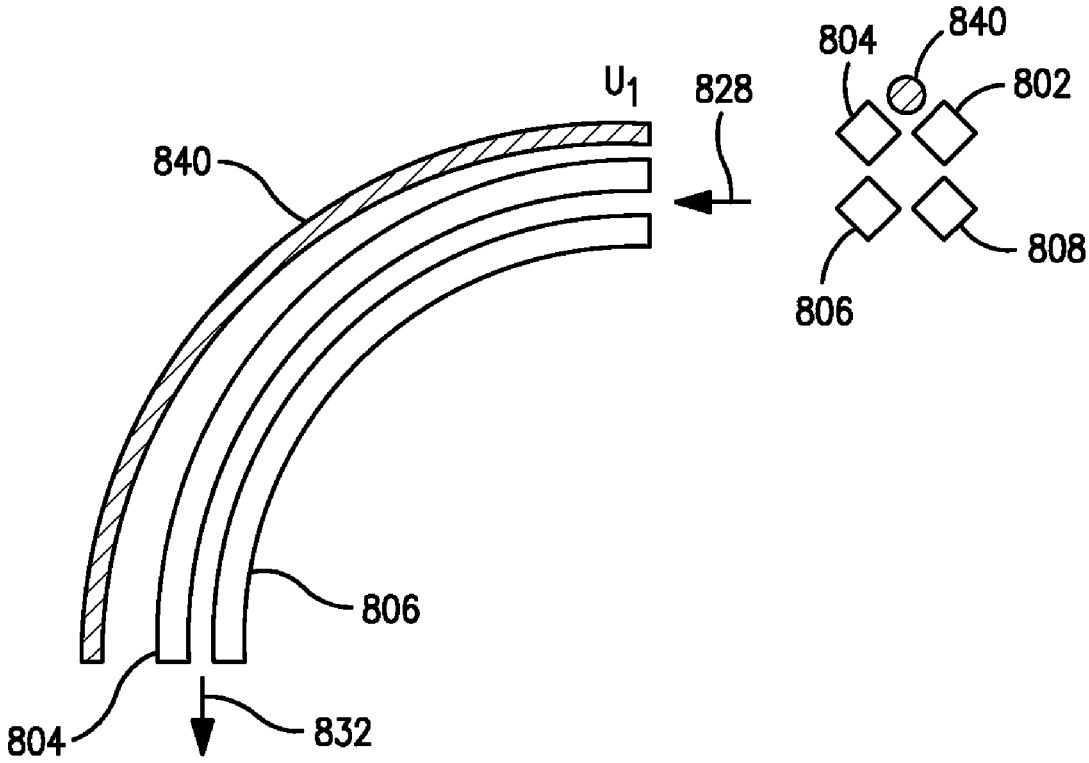
FIG. 8 is a schematic drawing of another example of ion guide from the perspective of its ion entrance, according to an implementation of the present disclosure.
Figure 9:
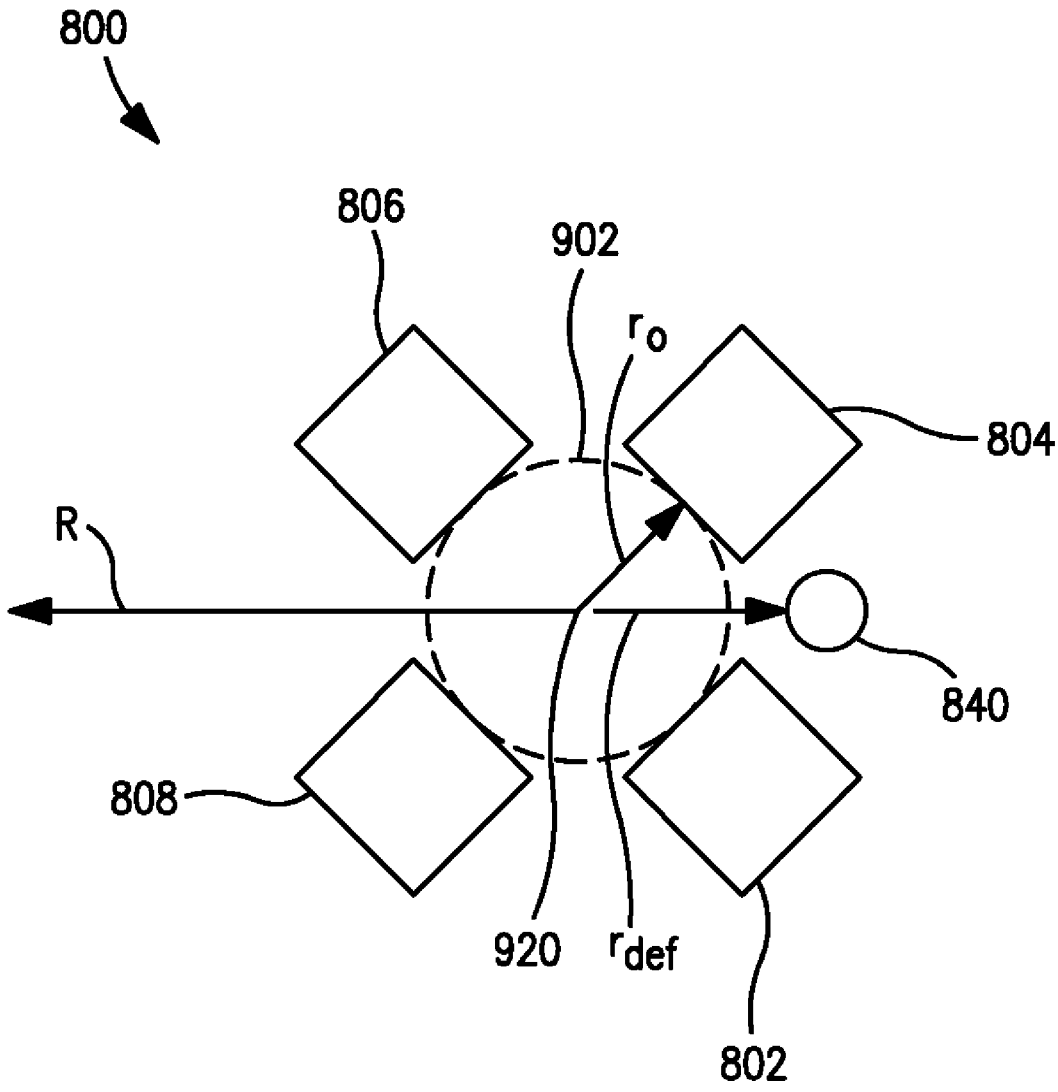
FIG. 9 is a view of the ion guide illustrated in FIGS. 8 and 9, in the radial or x-y plane at the ion entrance.

FIGS. 8 and 9 illustrate an example of an ion guide 800 configured according to an alternative implementation. Specifically, FIG. 8 is a perspective view of the ion guide 800 from the perspective of its ion entrance 828, and FIG. 9 is a view of the ion guide 800 in the radial or x-y plane at the ion entrance 828. The ion guide 800 may, for example, be utilized as the ion guide 100 described above and illustrated in FIG. 1 and as part of the accompanying the ion processing system 110. The ion guide 800 includes a plurality of curved electrodes arranged about a curved center axis 920, generally circumscribing an interior space of circular cross-section 902, and extending from the ion entrance 828 to an ion exit 832. The curved electrodes may include at least a pair of outer electrodes 802, 804 and a pair of inner electrodes 806, 808 as in other implementations described above. In this implementation, the outer electrodes 802, 804 and the inner electrodes 806, 808 are utilized primarily as ion guiding electrodes. The ion guiding electrodes 802, 804, 806 and 808 may be arranged relative to the central z-axis 920 and interconnected in the same manner as described above in conjunction with FIG. 2.

In the implementation illustrated in FIGS. 8 and 9, the ion deflecting device includes an additional curved electrode 840 that is utilized as an ion deflecting electrode. As illustrated, the ion deflecting electrode 840 may have a smaller cross-section than that of the ion guiding electrodes 802, 804, 806 and 808, and may have a differently-shaped cross-section. Preferably, the ion deflecting electrode 840 is located outside of the ion guiding region to facilitate its use in generating a radial DC deflecting field across the ion guiding region and so as not to interfere with ion processing operations occurring in the ion guiding region. Accordingly, as shown in FIG. 9, the ion deflecting electrode 840 is located at a radial distance $r_{def}$ from the curved axis 920 that is greater than the radial distance $r_0$ at which the ion guiding electrodes 802, 804, 806 and 808 are located. The ion deflecting electrode 840 may be located between the outer electrodes 802, 804. Generally, this means that the radius $r_{def}$ of the ion deflecting electrode 840 passes between the outer electrodes 802, 804 as shown in FIG. 9. As shown in FIG. 8, the radius $r_{def}$ of the ion deflecting electrode 840 varies over the curved length of the ion guide 800. As such, the ion deflecting electrode 840 is not parallel with either the curved axis 920 or the outer electrodes 802, 804 from the perspective of FIG. 8. Specifically, the radius $r_{def}$ is at a minimum at the ion entrance 828 as shown in FIG. 9 and gradually increases to a maximum toward the ion exit 832 as shown in FIG. 8. It may also be stated that the distance of the ion deflecting electrode 840 from the ion guiding region increases along the curved axis 920, or that the difference between the radius $r_{def}$ of the ion deflecting electrode 840 and radius $r_0$ (which is constant in the present example) of the ion guiding electrodes 802, 804, 806 and 808 increases along the curved axis 920. A DC ion deflecting voltage of magnitude $U_1$ is applied to the ion deflecting electrode 840 to generate a radial DC electric field across the ion guiding region. Because the spacing between the ion deflecting electrode 840 and the ion guiding region gradually increases along the curved axis 920, the strength of the resulting radial DC field (and hence the deflecting force imparted to the ions) gradually decreases in proportion thereto. The value for $U_1$ may be determined by considering the initial conditions of an ion at the ion entrance 828 in a manner similar to that described above in conjunction with the segmented ion guiding electrodes, and additionally taking into account the radius $r_{def}$ at the ion entrance 828. The varying curvature of the ion deflecting electrode 840 may be configured so as to realize a desired rate of decrease in the strength of the radial DC field. As also shown in FIG. 9, the minimum value of the radius $r_{def}$ may be such that ion deflecting electrode 840 is physically located in the gap between the outer electrodes 802, 804; this is not a requirement but may be desirable for minimizing the magnitude $U_1$ of the DC voltage required for this implementation.

Alternatively, the ion deflecting electrode 840 may be positioned between the inner electrodes 806, 808 instead of the outer electrodes 802, 804 (not shown). As before, this generally means at least that the radius $r_{def}$ of the ion deflecting electrode 840 passes between the inner electrodes 806, 808, whether or not the ion deflecting electrode 840 is actually physically present within the gap between the inner electrodes 806, 808 at any particular axial location. When located between the inner electrodes 806, 808, the DC voltage $U_1$ applied will have a polarity suitable for attracting positive or negative ions as the case may be, as opposed to repelling positive or negative ions when the ion deflecting electrode 840 is located between the outer electrodes 802, 804.

In yet another implementation (not shown but readily apparent from FIGS. 2, 8 and 9), an ion deflecting electrode may be provided similar to that illustrated in FIGS. 8 and 9, with the radius $r_{def}$ of the ion deflecting electrode being greater than the radius $r_0$ of the ion guiding electrodes 802, 804, 806 and 808 as before. The ion deflecting electrode may be positioned between either the outer electrodes 802, 804 or the inner electrodes 806, 808. However, in this alternative implementation, the radius $r_{def}$ as well as the radius $r_0$ is constant whereby the ion deflecting electrode remains parallel with the curved axis and the ion guiding electrodes 802, 804, 806 and 808 along the entire extent of the ion guide. In this implementation, instead of the radius $r_{def}$ varying, the ion deflecting electrode is axially segmented in a manner similar to the segmented ion guiding electrodes described above in conjunction with FIG. 2. DC voltages $U_1, \ldots U_N$ of decreasing magnitude are applied to respective segments of the ion deflecting electrode to generate the axially varying DC ion deflecting electric field.

Figure 10:
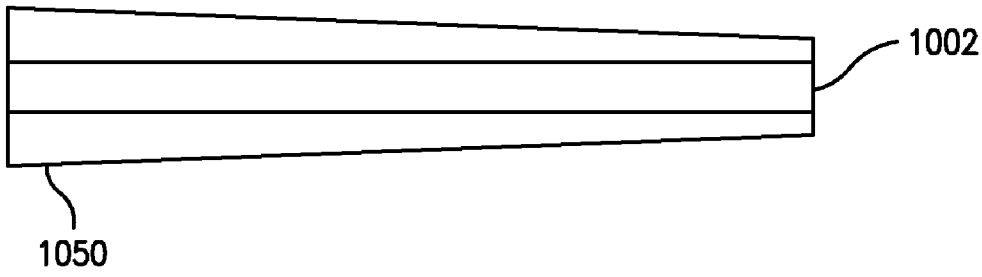
FIG. 10 is a two-dimensional projection in cross-section of an example of a curved electrode on which an electrically resistive layer is disposed according to an implementation of the present disclosure.
Figure 11:
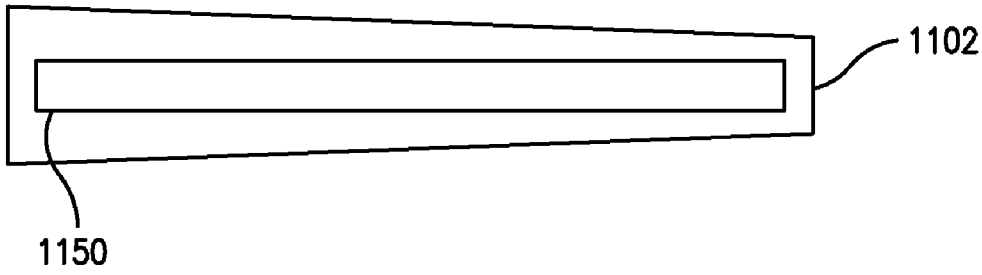
FIG. 11 is a two-dimensional projection of another example of a curved electrode on which an electrically resistive layer is disposed according to an implementation of the present disclosure.

FIGS. 10 and 11 illustrate another implementation in which a component (layer coating, etc.) composed of an electrically resistive material is disposed over the entirety or a portion of one or more curved electrodes of an ion guide. The resistive layer may be configured such that its resistance varies over the length of the electrode. A DC voltage potential is applied to the resistive layer at (between) the opposing axial ends of the electrode. Due to the varying resistance, the magnitude of the resulting radial DC ion deflecting field will likewise vary along the curved axis in proportion thereto. The RF trapping voltage and resulting RF trapping field will not be affected by the resistive layer. The varying resistance may be realized in a number of ways, for example by varying one or more dimensions or the shape of the resistive layer. Moreover, the resistive layer may be configured such that the DC ion deflecting potential varies either linearly or non-linearly (e.g., exponentially). As one example, FIG. 10 is a two-dimensional projection in cross-section of a curved electrode 1002 on which an electrically resistive component 1050 is disposed. The radial thickness of the resistive component 1050 varies along the length of the electrode 1002. As another example, FIG. 11 is a two-dimensional projection of another curved electrode 1102 on which an electrically resistive component 1150 is disposed. The shape or area of the resistive component 1150 varies along the length of the electrode 1102.

It will be understood that while certain examples described above focused on the usefulness of presently taught subject matter in the context of collision cells, the methods and apparatus described in the present disclosure may be implemented in any type of ion guide and are not limited to applications entailing the specific occurrence of CID or ion fragmentation. It will also be understood that the methods and apparatus described in the present disclosure may be implemented in an ion processing system such as an MS system as generally described above by way of example. The present subject matter, however, is not limited to the specific ion processing systems illustrated herein or to the specific arrangement of circuitry and components illustrated herein. Moreover, the present subject matter is not limited to MS-based applications.

In general, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limiting the invention being defined by the claims.

What is claimed is:

1. An ion guide comprising:

a plurality of curved electrodes arranged about a curved central axis, the curved central axis being co-extensive with an arc of a circular section having a radius of curvature, each electrode being radially spaced from the curved central axis, wherein the plurality of electrodes circumscribe a curved ion guide region arranged about the curved central axis, the ion guide region beginning at an ion entrance and ending at an ion exit; and an ion deflecting device configured for applying a radial DC electric field across the ion guide region at a magnitude that varies along the curved central axis, wherein the magnitude is at a maximum at the ion entrance and decreases along the curved central axis toward the ion exit.

2. The ion guide of claim 1, wherein the ion deflecting device comprises a DC voltage source communicating with at least one pair of the plurality of electrodes.

3. The ion guide of claim 1, further comprising an ion guiding voltage generator communicating with at least two opposing pairs of the plurality of electrodes, the ion guiding voltage generator configured for applying a RF voltage to the at least two opposing electrode pairs to generate a two-dimensional ion guiding field in the ion guide region.

4. The ion guide of claim 1, wherein at least one of the plurality of curved electrodes is divided into a plurality of electrode segments, each electrode segment being spaced from an adjacent electrode segment along the curved central axis.

5. The ion guide of claim 4, wherein the electrode segments have respective axial lengths and the axial length of at least one electrode segment is different from the axial lengths of the other electrode segments.

6. The ion guide of claim 4, wherein the plurality of curved electrodes comprises a pair of outer electrodes and a pair of inner electrodes, the outer electrode pair being positioned radially outwardly from the inner electrode pair relative to the radius of curvature, and the plurality of curved electrodes has a configuration selected from the group consisting of: the outer electrode pair being divided into the plurality of electrode segments, the inner electrode pair being divided into the plurality of electrode segments, and both the outer electrode pair and the inner electrode pair being divided into the plurality of electrode segments.

7. The ion guide of claim 4, wherein the plurality of curved electrodes comprises a pair of outer electrodes and a pair of inner electrodes, the outer electrode pair is positioned radially outwardly from the inner electrode pair relative to the radius of curvature, and further comprises a curved ion deflecting electrode positioned outside the ion guide region and divided into the plurality of electrode segments.

8. The ion guide of claim 1, wherein:

the plurality of curved electrodes comprises a pair of outer electrodes and a pair of inner electrodes, the outer electrode pair is positioned radially outwardly from the inner electrode pair relative to the radius of curvature;

the plurality of curved electrodes has a configuration selected from the group consisting of: the outer electrode pair being divided into N pairs of outer electrode segments, and the inner electrode pair being divided into N pairs of inner electrode segments;

each electrode segment pair is spaced from an adjacent electrode segment pair along the curved central axis, and the N pairs of electrode segments comprise a first electrode segment pair located at the ion entrance and an Nth electrode segment pair located at the ion exit; and the ion deflecting device comprises a DC voltage source communicating with the first electrode segment pair and configured for applying a DC deflecting voltage to the first electrode segment pair, the magnitude of the radial DC electric field being the greater in a portion of the ion guide region axially located with the first electrode segment pair than in a remaining portion of the ion guide region.

9. The ion guide of claim 8, wherein the DC voltage source communicates with a second electrode segment pair axially adjacent to the first electrode segment pair, the DC voltage source is configured for applying the DC deflecting voltage to the first electrode segment pair at a first magnitude, the DC voltage source is configured for applying a DC deflecting voltage of a second magnitude to the second electrode segment pair, and the first magnitude is greater than the second magnitude.

10. The ion guide of claim 1, wherein:

the plurality of curved electrodes comprises a pair of outer electrodes and a pair of inner electrodes, the outer electrode pair is positioned radially outwardly from the inner electrode pair relative to the radius of curvature;

the plurality of curved electrodes has a configuration selected from the group consisting of: the outer electrode pair being divided into N pairs of outer electrode segments, and the inner electrode pair is divided into N pairs of inner electrode segments;

each electrode segment pair is spaced from an adjacent electrode segment pair along the curved central axis, and the N pairs of electrode segments comprise a first electrode segment pair located at the ion entrance and an Nth electrode segment pair located at the ion exit; and the ion deflecting device comprises a DC voltage source communicating with each electrode segment pair, the DC voltage source configured for applying a DC deflecting voltage of a first magnitude to the first electrode segment pair and a DC deflecting voltage of an Nth magnitude to the Nth electrode segment pair, the first magnitude being the greatest magnitude applied and the Nth magnitude being the least magnitude applied.

11. The ion guide of claim 1, wherein:

the plurality of curved electrodes comprises a pair of outer ion guiding electrodes and a pair of inner ion guiding electrodes, the outer ion guiding electrode pair is positioned radially outwardly from the inner ion guiding electrode pair relative to the radius of curvature, each outer ion guiding electrode being positioned at an ion guiding electrode radius relative to the curved central axis; and the ion deflecting device comprises a curved ion deflecting electrode positioned at an ion deflecting electrode radius greater than the ion guiding electrode radius relative to the curved central axis, the ion deflecting electrode having a configuration selected from the group consisting of: the ion deflecting electrode radius passing between the pair of outer ion guiding electrodes with the ion deflecting electrode radius being at a minimum at the ion entrance and increasing toward the ion exit, and the ion deflecting electrode radius passing between the pair of inner ion guiding electrodes with the ion deflecting electrode radius being at a maximum at the ion entrance and decreasing toward the ion exit.

12. The ion guide of claim 11, wherein the ion deflecting device comprises a DC voltage source communicating with the ion deflecting electrode.

13. The ion guide of claim 1, wherein:

the plurality of curved electrodes comprises a pair of outer ion guiding electrodes and a pair of inner ion guiding electrodes, the outer ion guiding electrode pair is positioned radially outwardly from the inner ion guiding electrode pair relative to the radius of curvature, each inner ion guiding electrode is positioned at an ion guiding electrode radius relative to the curved central axis; and the ion deflecting device comprises an electrically resistive component disposed on either the outer electrodes or the inner electrodes, the resistance of the component varying along the curved central axis.

14. The ion guide of claim 1, wherein:

the plurality of curved electrodes comprises a pair of outer electrodes and a pair of inner electrodes, the outer electrode pair is positioned radially outwardly from the inner electrode pair relative to the radius of curvature;

the outer electrode pair is divided into N pairs of outer electrode segments, each outer electrode segment pair is spaced from an adjacent outer electrode segment pair along the curved central axis, and the N pairs of outer electrode segments comprising a first outer electrode segment pair located at the ion entrance and an Nth outer electrode segment pair located at the ion exit;

the inner electrode pair is divided into N pairs of inner electrode segments, each inner electrode segment pair being spaced from an adjacent inner electrode segment pair along the curved central axis, and the N pairs of inner electrode segments comprises a first inner electrode segment pair located at the ion entrance and an Nth inner electrode segment pair located at the ion exit; and the ion deflecting device comprises a DC voltage source communicating with the outer electrode segment pairs and the inner electrode segment pairs, the DC voltage source configured for applying a DC deflecting field of a first magnitude between the first outer electrode segment pair and the first inner electrode segment pair, and a DC deflecting field of an Nth magnitude between the Nth outer electrode segment pair and the Nth inner electrode segment pair, the first magnitude being the greatest magnitude applied and the Nth magnitude being the least magnitude applied.

15. The ion guide of claim 1, wherein the ion deflecting device is configured for applying the radial DC electric field at a magnitude of $U_{deflect}$ at the ion entrance, $U_{deflect}$ being proportional to an initial ion energy (E) of an ion entering the ion entrance, to the inscribed radius ($r_0$) of the plurality of curved electrodes about the central axis, and to the radius of curvature (R), according to the relation $U_{deflect}=k*E*(r_0/R)$, where k is a constant of proportionality dependent on the cross-section and dimensions of the plurality of curved electrodes.

16. A method for guiding an ion through an ion guide, the method comprising:

transmitting the ion into a curved ion guide region of the ion guide, the ion guide region being circumscribed by a plurality of curved electrodes arranged about a central curved axis, the curved central axis running through the ion guide region co-extensively with an arc of a circular section having a radius of curvature, each electrode being radially spaced from the curved central axis, wherein the curved ion guide region is arranged about the curved central axis, the ion guide region beginning at an ion entrance and ending at an ion exit;

generating a RF electric field across the ion guide region to focus the ion to motions generally along the curved central axis; and generating a radial DC electric field across the ion guide region at a magnitude that varies along the central curved axis to provide an axially varying, radially directed ion deflecting force, <wherein the magnitude is at a maximum at the ion entrance and decreases along the curved central axis toward the ion exit.

17. The method of claim 16, wherein at least one of the plurality of curved electrodes is divided into a plurality of electrode segments, each electrode segment being spaced from an adjacent electrode segment along the curved central axis, and generating the radial DC electric field comprises applying a DC voltage to one or more of the electrode segments, with the greatest magnitude of the radial DC voltage being applied to the electrode segment located at the ion entrance.

18. The method of claim 17, wherein:

the plurality of curved electrodes comprises a pair of outer electrodes and a pair of inner electrodes, the outer electrode pair being positioned radially outwardly from the inner electrode pair relative to the radius of curvature, and the plurality of curved electrodes has a configuration selected from the group consisting of: the outer electrode pair being divided into a plurality of pairs of the electrode segments, the inner electrode pair being divided into a plurality of pairs of the electrode segments, and both the outer electrode pair and the inner electrode pair being divided into a plurality of pairs of the electrode segments; and generating the DC electric field comprises applying the DC voltage to one or more of the electrode segment pairs, with the greatest magnitude of the DC voltage being applied to the electrode segment pair located at the ion entrance.

19. The method of claim 16, wherein generating the DC electric field comprises applying a DC voltage to a curved ion deflector positioned outside the ion guide region.

20. The method of claim 19, wherein the DC voltage is applied to the curved ion deflector in a manner selected from the group consisting of: the curved ion deflector being spaced from the curved central axis at a minimum radial distance at the ion entrance and at an increasing radial distance along the curved central axis from the ion entrance, such that the magnitude of the radial DC electric field varies in dependency on the radial distance of the curved ion deflector, and the curved ion deflector being divided into a plurality of axially spaced electrode segments such that the radial DC electric field varies in dependency on the magnitude of the DC voltage applied to a given electrode segment.

* * * * *